United States Patent [19]

Uchida et al.

[11] Patent Number: 4,458,664

[45] Date of Patent: Jul. 10, 1984

[54] OIL STOVE

[75] Inventors: Tetsue Uchida; Takao Adachi, both of Sanjyo, Japan

[73] Assignee: Uchida Manufacturing Co., Ltd., Niigata, Japan

[21] Appl. No.: 464,147

[22] Filed: Feb. 7, 1983

[51] Int. Cl.[3] ..... F24C 5/04; F23D 3/32; G05G 1/10

[52] U.S. Cl. ..... 126/96; 431/307; 74/553

[58] Field of Search ..... 74/504, 528, 553, 483 K; 70/219, 220; 194/94; 126/92 B, 92 R, 96, 45, 97, 49; 431/304, 305, 306, 307, 308

[56] References Cited

U.S. PATENT DOCUMENTS

| | | | |
|---|---|---|---|
| 509,189 | 11/1893 | Welch | 431/305 |
| 833,738 | 10/1906 | Frey | 431/307 |
| 1,458,414 | 6/1923 | Huenefeld | 431/307 |
| 1,484,172 | 2/1924 | Chadwick | 431/307 |
| 1,505,240 | 8/1924 | Bennett | 431/307 |
| 2,011,982 | 8/1935 | Richardson | 126/96 |
| 2,445,211 | 7/1948 | Drake | 74/553 |
| 2,477,589 | 8/1949 | Du Shane | 74/483 K |
| 3,019,667 | 2/1962 | Bann | 74/553 |
| 3,279,524 | 10/1966 | Nozaki et al. | 126/96 |

*Primary Examiner*—Samuel Scott
*Assistant Examiner*—G. Anderson
*Attorney, Agent, or Firm*—Cushman, Darby & Cushman

[57] ABSTRACT

An improved oil stove of the type including a cylindrical burning wick adapted to be raised up or lowered as required by actuating a wick control handle is disclosed which includes a stopper slidably secured to the wick control handle and a stopper engagement member to which the stopper comes in engagement as the wick control handle is rotated. The stopper comprises a base plate, an engagement projection and a depress button adapted to be depressed by an operator's finger. The engagement projection is extended from the base plate to the position where it is engaged to the stopper engagement member at its upright bent portion of which upper end face is tapered. As the wick control handle is rotated in such a direction as to lower the wick, the bent portion of the engagement projection abuts against the stopper engagement member and thereby the wick control handle fails to be rotated further. On the contrary, as the wick control handle is rotated in the opposite direction so as to raise up the wick, the stopper engagement member comes in sliding contact with the tapered end face of the engagement projection and therefore the wick control handle continues to be rotated without any hindrance. When the wick control handle is to be rotated further in the direction of lowering of the wick, the depress button is manually depressed so that the whole stopper is disengaged from the stopper engagement member. Thus, the wick control handle can be operated further.

3 Claims, 9 Drawing Figures

OIL STOVE

BACKGROUND OF THE INVENTION

1. Field of the Invention

The present invention relates to an oil stove of the type including a cylindrical burning wick adapted to be raised up or lowered by operating a wick control handle and more particularly to an improved oil stove which is constructed such that when the wick control handle is operated in such a direction as to lower the wick, the latter is lowered just by a predetermined distance corresponding to a single rotation of the wick control handle with the aid of a stopper slidably secured to the wick control handle and moreover when it is to be operated further, the stopper is disengaged from the locked state, whereby dangerous fire flashing is effectively prevented which tends to often take place when the wick is quickly retracted to the lowermost position for the purpose of extinguishing a burning fire.

2. Description of the Prior Art

A hitherto known oil stove of the abovementioned type is constructed such that the wick is quickly lowered by operating the wick control handle when fire extinguishment is required. It has been recognized as a dangerous problem with respect to the conventional oil stove that fire flashing often takes place as if a fire column is developed, when the wick is quickly retracted to the lowermost position. This is mainly because of the fact that air held in the space below the burning chamber is subjected to abrupt expansion due to exposure to the lowered wick which is kept still hot. Sometimes an operator suffers from a burn on his hand, face or the like. In an extreme case a tragic fire may be caused by the aforesaid fire flashing.

SUMMARY OF THE INVENTION

In view of the dangerous problem with respect to the conventional oil stove as described above there is proposed in accordance with the present invention an improved oil stove which is constructed such that the wick can be lowered only by a predetermined distance with the aid of a stopper at every time when the wick control handle is operated in such a direction as to lower it. The stopper is slidably secured to the wick control handle and includes an engagement projection, whereas a stopper engagement member is disposed at the foremost end of a bearing sleeve through which a wick control shaft is extended so that it comes in engagement to said engagement projection on the stopper as the wick control handle is rotated. The engagement projection has an upright bent portion at the foremost end thereof of which upper end face is tapered. Further, the stopper includes a depress button by means of which the whole stopper is manually disengaged from the locked state.

When the wick control handle is operated in such a direction as to lower the wick for the purpose of fire extinguishment, the engagement projection of the stopper comes in engagement against the stopper engagement member on the bearing sleeve during at least a single rotation of the wick control handle, whereby the latter fails to be operated further. Thus, quick lowering of the wick is effectively inhibited. Next, the depress button is depressed by an operator's finger and thereby the stopper is disengaged from the stopper engagement member. The wick control handle is ready to be operated further so as to lower the wick. To sum up the lowering operation of the wick is carried out step by step at every time when the depress button on the stopper is actuated, until the wick is retracted to the lowermost position where the burning wick becomes extinguished. As a result it is ensured that such a fire flash does not take place as is the case with the conventional oil stove of which burning wick is quickly retracted.

On the other hand, when the wick control handle is operated in the opposite direction so as to raise up the wick, the stopper engagement member slides along the tapered end face of the engagement projection. Thus, the wick control handle continues to be operated without any hindrance in the same manner as the conventional oil stove, until the wick is raised up to the required height.

Hence, it is an object of the present invention to provide an oil stove which does not suffer from fire flashing when a burning wick is lowered for the purpose of fire extinguishment.

It is other object of the present invention to provide an oil stove which is operated in the same manner as the conventional one when the wick is to be raised up.

It is another object of the present invention to provide an oil stove which includes a stopper and an engagement member both of which are simple in structure and can be manufactured at an inexpensive cost.

Other objects, features and advantages of the present invention will become readily apparent from the readihg of the following description made in conjunction with the accompanying drawings.

BRIEF DESCRIPTION OF THE DRAWINGS

The accompanying drawings will be briefly described below.

DETAILED DESCRIPTION OF PREFERRED EMBODIMENT

To facilitate understanding of the present invention a typical conventional oil stove will be briefly described with reference to FIGS. 1 and 2.

Figure 1:
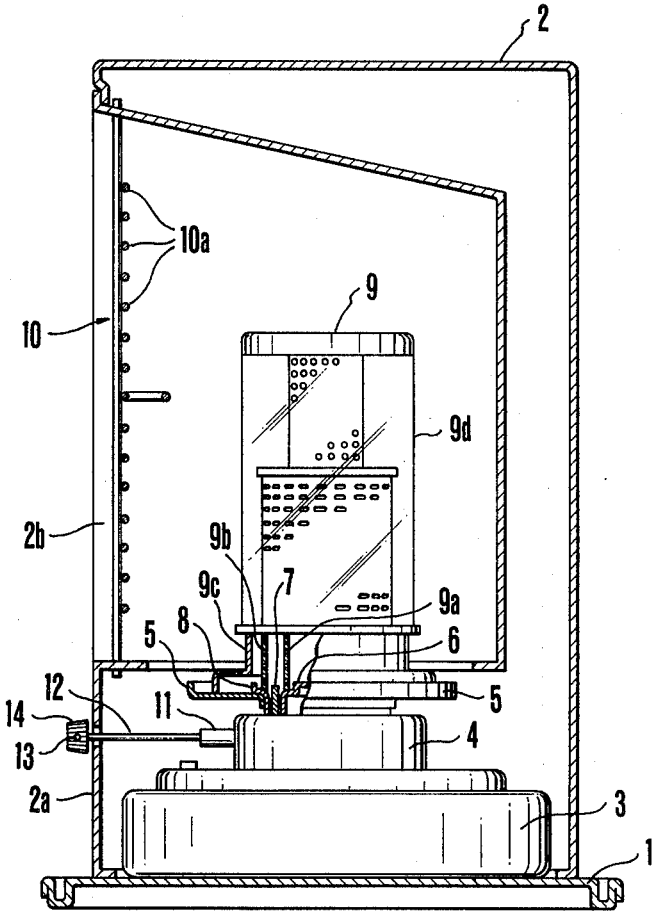
FIG. 1 is a vertical sectional view of a typical conventional oil stove.

Referring to FIG. 1, the conventional oil stove includes a base 1, a cabinet 2 fixedly mounted on said base 1, an oil tank 3 fixedly mounted on the base 1 within said cabinet 2 and a wick guide case 4 disposed above said oil tank 3 in the integral structure. Around the upper circular edge of the wick guide case 4 is disposed a wind shield plate 5 with a circular wind shield wall fixedly secured to the outermost rim thereof, whereas within the wick guide case 4 is displaceably fitted a cylindrical wick 7 with an inner wick guide sleeve 6 located inward of said wick 7. A hot dish 8 is attached to the innermost rim of the wind shield plate 5, standing upright above the latter by a short distance.

Further, a burning sleeve 9 is placed on the hot dish, encasing the wick 7. The burning sleeve 9 is designed in a cylindrical configuration and a burning chamber is constituted by an inner sleeve 9*a* and an intermediate sleeve 9*b* located outward of said inner sleeve 9*a*, both the inner and intermediate sleeves 9*a* and 9*b* having a certain number of ventilation holes (not shown) formed thereon.

Outward of the intermediate sleeve 9*b* is disposed an outer sleeve 9*c* on which a wind shield sleeve 9*d* made of glass is firmly placed.

Figure 2:
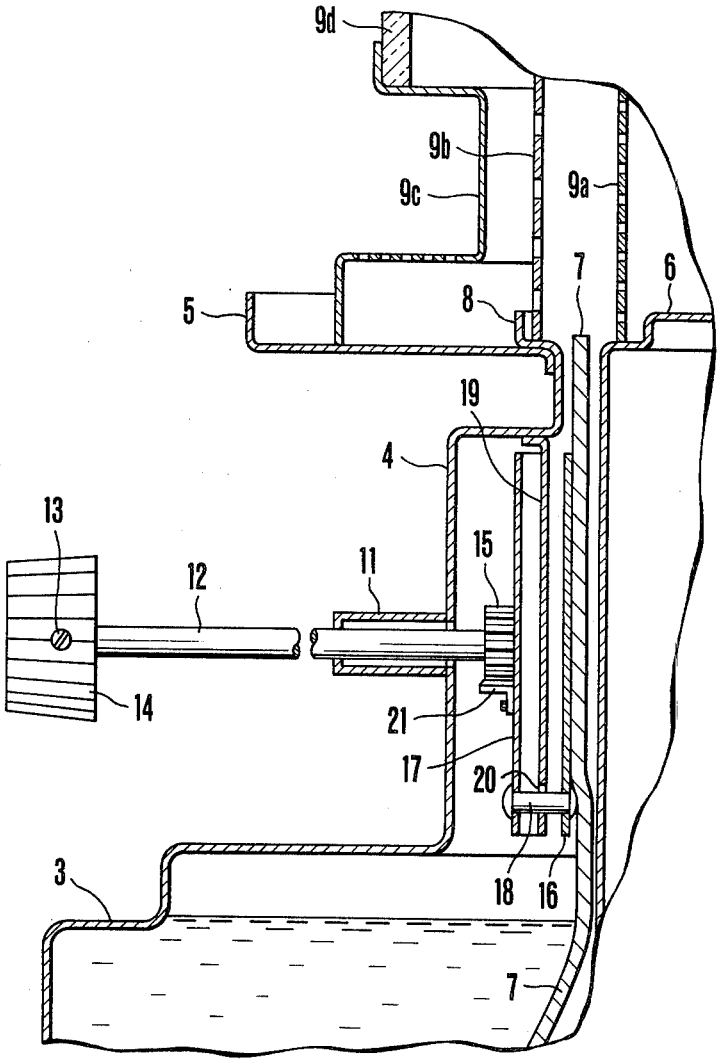
FIG. 2 is a partial vertical sectional view of the oil stove in FIG. 1, illustrating in an enlarged scale a wick raising and lowering mechanism, a wick control handle and other essential parts in the oil stove.
Figure 4:
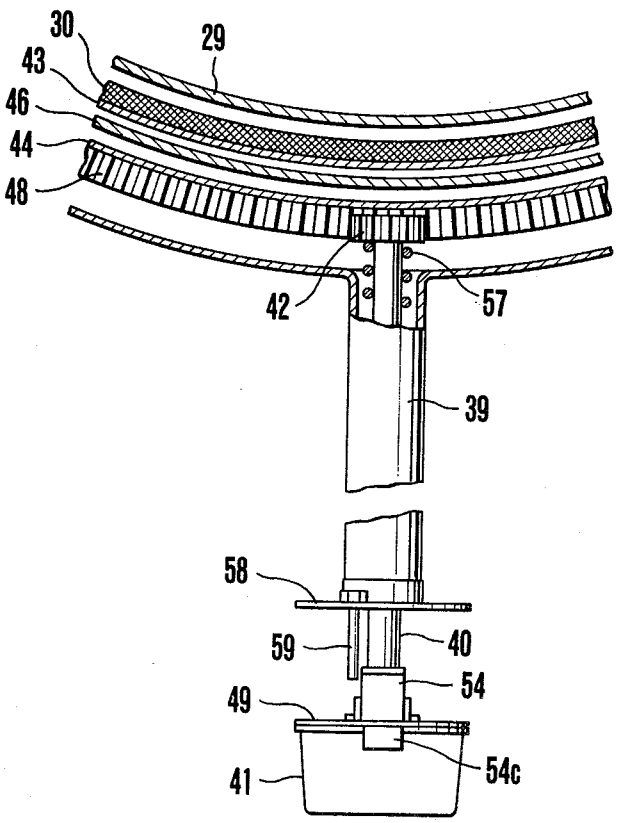
FIG. 4 is a partial plan view of the oil stove in FIG. 3 partially sectioned, illustrating in an enlarged scale a wick control handle and a wick raising and lowering mechanism.

As is best seen from FIG. 2, the lowermost end part of the inner sleeve 9*a* abuts against the upper end face of the inner wick guide sleeve 6, the lowermost end part of the intermediate sleeve 9*b* does against the hot dish 8 and the lowermost end part of the outer sleeve 9*c* does against the wind shield plate 5.

The cabinet 2 includes a front plate 2*a* at the lower part of the front side and a rectangular cutout 2*b* is formed above said front plate 2*b* on the cabinet 2. The rectangular cutout 2*b* is fitted with a guard 10 comprising a number of horizontally extending fence rods 10*a*.

The wick guide case 4 includes a bearing sleeve 11 projecting therefrom to the front side (in the leftward direction as seen in the drawing) so that a wick actuating shaft 12 is rotatably held in said bearing sleeve 11. A wick actuating handle 14 is fixedly secured onto the wick actuating shaft 12 at its foremost end by means of a set screw 13, whereas a pinion 15 is fixedly mounted on the innermost end part of the wick actuating shaft 12.

A wick fastening band 16 is attached to the outer surface of the wick 7 and a cylindrical rotary plate 17 is displaceably disposed outward of said wick fastening band 16. Both the wick fastening band 17 and the rotary plate 17 are operatively connected to one another at the lowermost end part by means of a pin 18 of which both ends are fixed to them. Further, between the wick fastening band 16 and the rotary plate 17 is located a cylindrical stationary plate 19 of which upper end is fixedly secured to the inner wall of the upper part of the wick guide case 4, said stationary plate 19 including an elongated hole 20 formed thereof which extends at a certain inclination angle relative to the horizontal plane so that the pin 18 is inserted through said elongated hole 20. Thus, the combined structure comprising the wick 7, the wick fastening band 16 and the rotary place 17 is carried by means of the stationary plate 19 with the aid of the connecting pin 18 inserted through the elongated hole 20 on the stationary plate 19. The rotary plate 17 has a rack 21 fixedly secured onto the outer wall thereof which meshes with the pinion 15 at the innermost end of the wick actuating shaft 12, whereby the wick 7 is raised up or lowered as required by rotating the wick actuating handle 14.

It is often found that a burning fire flashes upward above the burning chamber abruptly as if a fire column is developed for the reason as mentioned below when the buring wick 7 is retracted to the lowermost end position from the raised one by rotating the wick actuating shaft 14 for the purpose of extinguishing the burning fire. Namely, the fire flash is caused because of the fact that when the wick 7 is lowered, air held in the space located below the hot dish 5 and another air repelled by downward movement of the wick 7 are quickly expanded by their exposure to the wick 7 which is still hot and they are then blown up toward the residual fire. As a result a burning trouble takes place on an operator's face or hand and in an extreme case there is a fear of causing a fire. Another problem is that incompletely burnt gas having unpleasant odor is produced and emitted to the outside.

The present invention is intended to obviate the drawbacks inherent to the conventional oil stove as described above.

Now the present invention will be described in a greater detail hereunder with reference to FIGS. 3 to 9.

Figure 3:
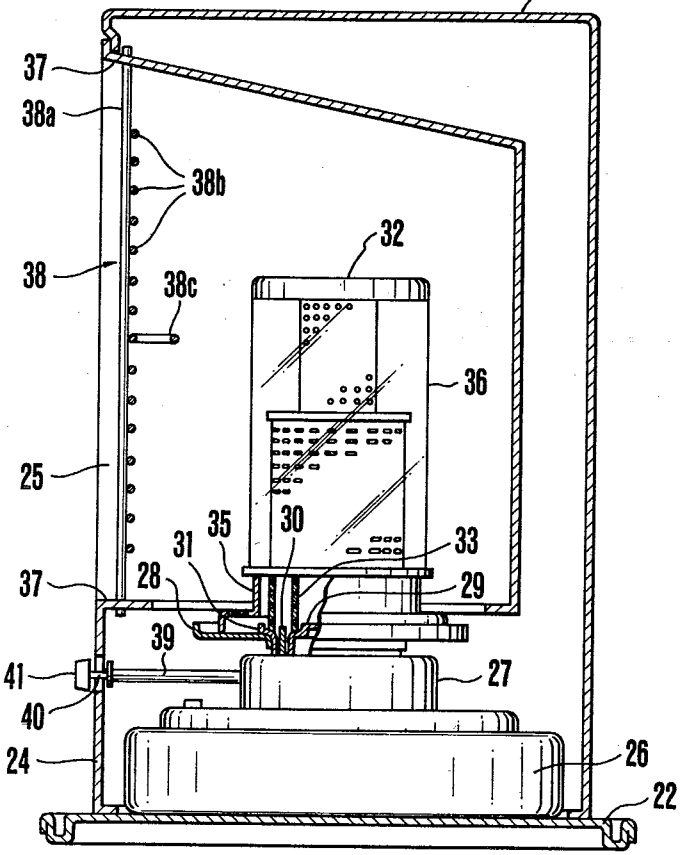
FIG. 3 is a vertical sectional view of an oil stove in accordance with the present invention.

Referring to FIG. 3, an oil stove in accordance with the present invention includes a base 22 and a cabinet 23 fixedly mounted on said base 22. The cabinet 23 is designed in a box-shaped configuration and its front face (at the left side as seen in the drawing) is opened. Further, the cabinet 23 has a front plate 24 at the lower part of the left side and a rectangular cutout 25 is formed above the front plate 24.

An oil tank 26 is fixedly mounted on the base 22 in the cabinet 23 and a wick guide case 27 is secured onto the upper part of the oil tank 26 in the integral structure. Around the upper peripheral edge of the wick guide case 27 is fixedly disposed a wind shield plate 28 with a wind shield wall attached to the outermost edge thereof, whereas within the wick guide case 27 is displaceably fitted a cylindrical burning wick 30 with an inner wick guide sleeve 29 located inward thereof.

A hot dish 31 is fitted around the inner rim of the wind shield plate 28 and further a burning sleeve 32 is placed on said hot dish 31 in such a manner as to encase the burning wick 30.

The burning sleeve 32 includes an inner sleeve 33 and an intermediate sleeve 34 located outward of said inner sleeve 33 so that a burning chamber is constituted by a combination of said inner and intermediate sleeves 33 and 34 on which ventilation holes are formed. Further, an outer sleeve 35 is disposed outward of the intermediate sleeve 34 and a wind shield sleeve 36 made of glass is firmly placed on said outer sleeve 35.

Figure 5:
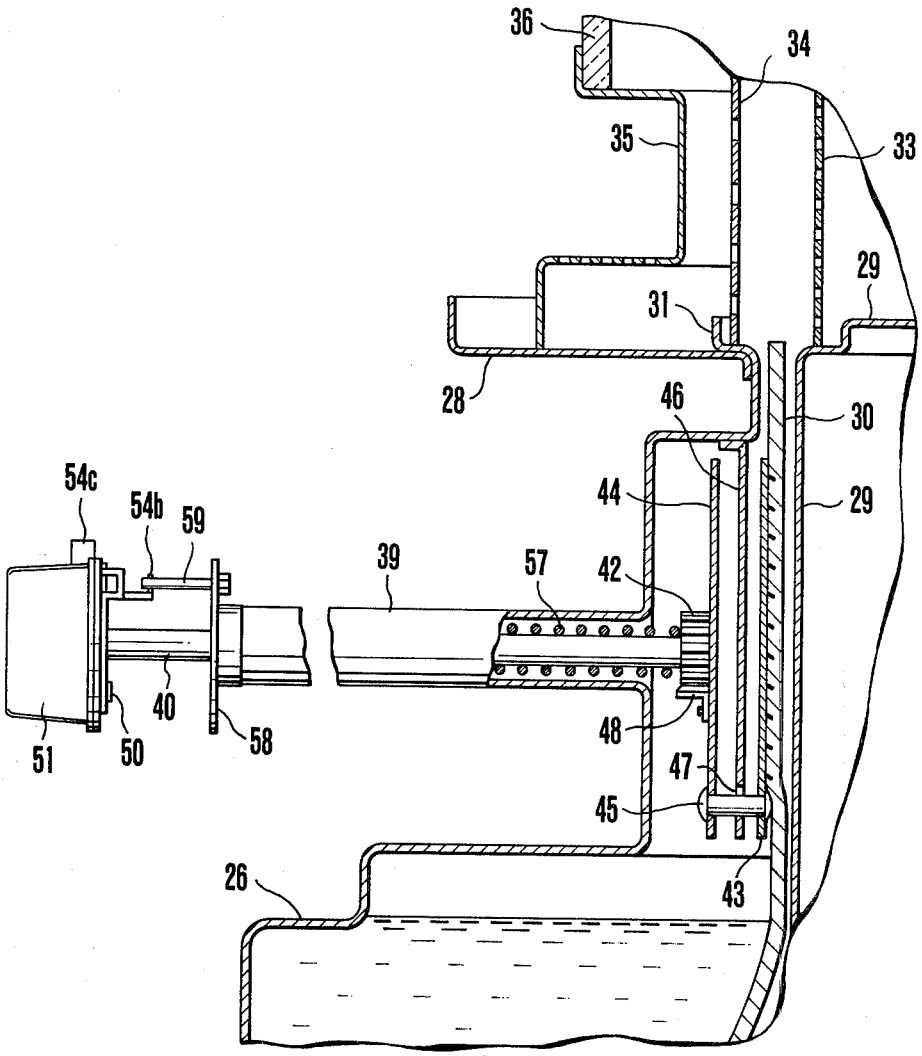
FIG. 5 is a partial vertical sectional view of the oil stove similar to FIG. 2, shown in an enlarged scale.
Figure 6:
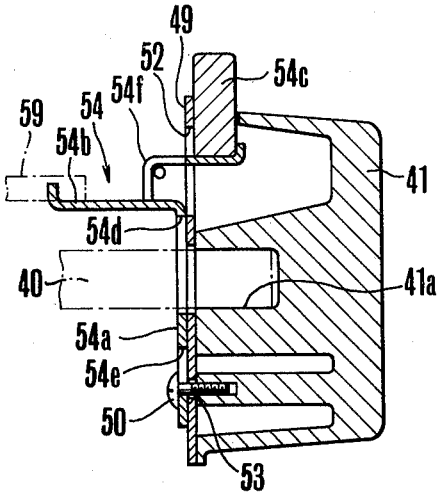
FIG. 6 is a vertical sectional view of the wick control handle with a stopper secured thereto, illustrating the detailed structure of the same.

As is best seen from FIG. 5, the lower end part of the inner sleeve 33 abuts against the upper face of the inner wick guide sleeve 29, the lower end part of the intermediate sleeve 34 does against the hot dish 31 and the lower end part of the outer sleeve 35 does against the wind shield plate 28.

The front cutout 25 of the cabinet 23 is detachably fitted with a guard 38 extending between both the upper and lower bent rims 37 and 37'. As is apparent from FIG. 3, the guard 38 comprises two vertical support rods 38*a* and a certain number of fence rods 38*b* horizontally extending in parallel to one another in an equally spaced relation, said fence rods 38*b* being welded to the support rods 38*a* at the rear side. Reference numeral 38*c* designates a burning sleeve guide member which becomes effective in displacing the burning sleeve away from the hot dish when the oil stove falls down on a floor or ground because of an occurrence of earthquake or the like and thereby the burning sleeve is caused to tilt toward the guard.

Further, the wick guide case 27 includes a bearing sleeve 39 projecting therefrom to the front through which a wick control rod 40 extends. On the outermost end of the wick control rod 40 is fitted a wick control handle 41 fixed thereto by means of a set screw, whereas on the innermost end of the wick control rod 40 is firmly fitted a pinion 42.

A wick fastening band 43 is attached to the outer surface of the wick 30 and a cylindrical rotary plate 44 is displaceably disposed outward of said wick fastening band 43, both the wick fastening band 43 and the rotary plate 44 being operatively connected to one another by means of a pin 45 at their lower end part. Further, between the wick fastening band 43 and the rotary plate 44 is located a cylindrical stationary plate 46 of which upper end is fixedly secured to the inner wall of the upper part of the wick guide case 27, said stationary plate 46 having an elongated support hole 47 formed on the outer surface thereof at a certain inclination angle relative to the horizontal plane. The connecting pin 45 is inserted through the elongated hole 47 so as to connect the wick fastening band 43 to the rotary plate 44. Thus, the combined structure of the wick 30, the wick fastening band 43 and the rotary plate 44 is displaceably held by means of the stationary plate 46 with the aid of the connecting pin 45.

The rotary plate 44 has a rack 48 fixedly secured to the outer surface thereof which meshes with the pinion 42 at the innermost end of the wick control rod 40. As the wick control handle 41 is rotated, rotation of the wick control handle 41 is transmitted to the rotary plate 44 by way of meshing engagement of the pinion 42 and the rack 48 whereby the wick 30 is raised up or lowered as required while it rotates around the inner wick guide sleeve 29.

Figure 8:
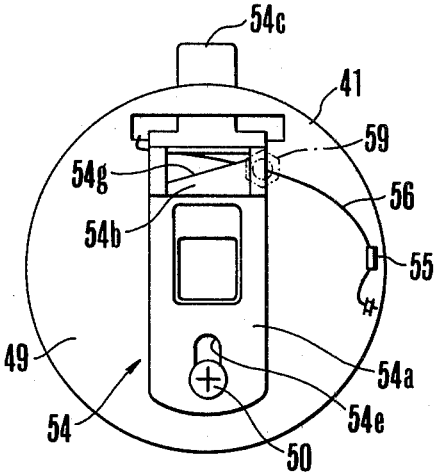
FIG. 8 is an elevational view of the wick control handle as seen from the back.
Figure 7:
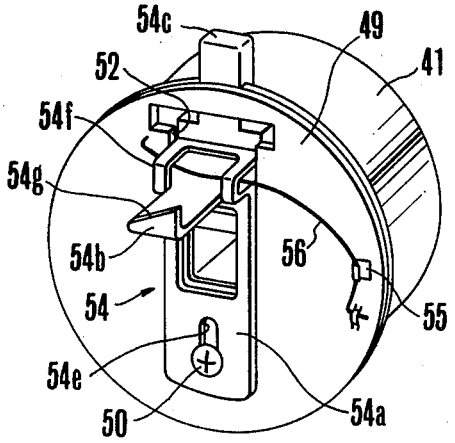
FIG. 7 is a perspective view of the wick control handle and the stopper in FIG. 6.
Figure 9:
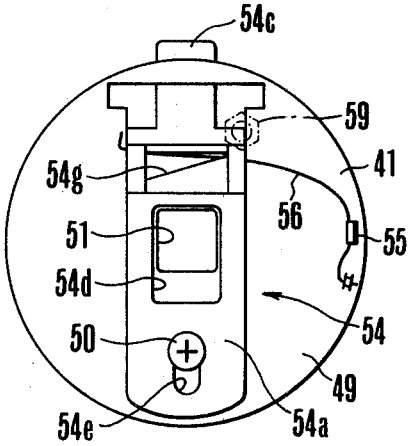
FIG. 9 is a perspective view of the wick control handle similar to FIG. 8, wherein the stopper is displaced to an unlocked position.

As is best seen from FIG. 8, the wick control handle 41 is designed in a truncated conical configuration and includes a base plate 49 attached thereto by means of a set screw 50. The base plate 49 has a square hole 51 located at the central part thereof through which the wick control rod 40 extends, a rectangular stopper insert hole 52 located above said square hole 51 and a screw insert hole 53 located at the lower part of the base plate.

A stopper 54 constituting an essential part of the present invention is slidably fitted onto the base plate 49. Specifically, the stopper 54 comprises a base plate portion **54*a*, an engagement projection 54*b* and a depress button 54*c*. The base plate portion 54*a* includes a rectangular shaft hole 54*d* located at the central part thereof and having a width larger than the diameter of the wick control shaft 40 and an enlongated hole 54*e* along which the screw 50 slides, whereas it includes an U-shaped bifurcated bent portion 54*f* located above the shaft hole 54*d* and projecting therefrom to the front in the same direction as the engagement projection 54*b*. The upper part of the bifurcated bent portion 54*f* extends in the opposite direction relative to the engagement projection 54*b* until it is in operative connection with the bottom of the depress button 54*c* at the foremost end and thereby the stopper 54 is depressed by the latter. The engagement projection 54*c* projecting at a right angle relative to the base plate portion 54*a* is bent upward at the foremost end and the bent portion has an inclined face 54*g* at its upper end. The stopper 54 is slidably fitted onto the base plate 49 by inserting the upper part thereof through the stopper insert hole 52 and fitting the set screw 50 through the elongated hole 54*e* on the stopper 49 and the screw insert hole 53 on the base plate 49 into a threaded hole on the wick control handle 41**.

To ensure that the depress button **54*c* on the stopper 54 is normally projected above the outer surface of the wick control handle 41 a wire spring 56 is provided adjacent to the base plate 49 in such a manner that one end of said wire spring 56 is anchored at a spring retainer 55 on the side wall of the base plate 49 and the other end of the same is extended through the U-shaped bifurcated bent portion 54*f***.

The outermost end part of the wick control shaft 40 is fitted into a hole **41*a* on the wick control handle 41 through the hole 51 on the base plate 49 and the hole 54*d* on the stopper 54, whereas the inner part of the wick control rod 40 is loosely held in the bearing sleeve 39 with a coil spring 57 mounted thereon so as to allow the pinion 42 at the innermost end part to be normally brought in meshing engagement with the rack 48 on the rotary plate 44**.

On the other hand, the bearing sleeve 39 includes a support disc 58 fixedly secured to the foremost end thereof and a stopper engagement member 59 is disposed at the outer end of said support disc 58. Specifically, the stopper engagement member 59 extends in parallel to the wick control shaft 40 until its foremost end is operatively engaged to the engagement projection **54*b* of the stopper 54**.

Next, operation of the oil stove as constructed in the above-mentioned manner will be described below.

It is assumed that the wick 30 is raised up by rotating the wick control handle 41 in the clockwise direction. As the wick control handle 41 is rotated further, the engagement projection **54*b* of the stopper 54 comes in engagement to the stopper engagement member 59. Since the upright bent portion of the engagement projection 54*b* is designed in the form of a tapered face 54*g* at the upper end, the whole stopper 54 is depressed against the resilient force of the wire spring 56 as the stopper engagement member 59 slides along the tapered end face 54*g* of the engagement projection 54*b*. As a result the wick control handle 41 can be rotated without any hindrance in such a direction that the wick 30** is raised up as required.

On the contrary, when the wick control handle 41 is rotated in the anticlockwise direction so as to lower the wick 30, the engagement projection **54*b* of the stopper 54 comes in engagement to the stopper engagement member 59 as illustrated in FIG. 8, while the wick control handle 41 is rotated at least by a single revolution. Thus, the wick control handle 41 cannot be operated any longer and thereby the wick 30 fails to be lowered. To rotate the wick control handle it is necessary to actuate the depress button 54*c* of the stopper 54 by an operator's finger. When the stopper 54 is lowered from the position in FIG. 8 to the position in FIG. 9, the engagement projection 54*b* of the stopper 54 is caused to be disengaged from the stopper engagement member 59 and the wick control handle 41 is ready to be rotated further in the anticlockwise direction until the wick 30** is lowered to the required position.

Since the wick can be lowered just by a predetermined distance as defined by means of the stopper as constructed in the above-described manner, it is ensured that no fire flashing takes place when the oil stove is operated.

While the present invention has been described above merely with respect to the illustrated embodiment, it should be of course understood that the present invention should be not limited only to it and various changes or modification may be made without any departure from the spirit and scope of the invention.

What is claimed is:

1. In an oil stove of the type including a cylindrical burning wick adapted to be raised up or lowered by operating a wick control handle, the improvement consisting in that the wick control handle fitted onto the foremost end part of a wick control shaft includes a stopper slidably secured to the inside wall of the wick control handle, said stopper comprising a base plate portion, an engagement projection projecting from said base plate portion in the inward direction, said engagement projection having an upright bent part of which upper end face is tapered, and a depress means adapted to depress the base plate portion together with the engagement projection in the direction of disengagement, said depress means being projected above the outer surface of the wick control handle so as to allow it to be depressed by an operator's finger, and a bearing sleeve through which the wick control shaft is extended includes a stopper engagement member at the foremost end thereof which is extended until it comes in engagement with the engagement projection of the stopper, whereby as the wick control handle is operated to lower the wick it comes to a stop during at least each complete rotation due to engagement of the engagement projection of the stopper against the stopper engagement member on the bearing sleeve, the engagement projection is disengaged from the stopper engagement member when the depress means is manually depressed so as to continue lowering of the wick.

2. An oil stove as defined in claim 1, wherein when the wick control handle is operated in such a direction as to raise up the wick, the engagement projection of the stopper comes in engagement against the stopper engagement member on the bearing sleeve at the tapered end face and thereby the whole stopper is depressed as the stopper engagement member slides along the tapered end face of the engagement projection whereby the wick control handle continues to be rotated without any hindrance.

3. An oil stove as defined in claim 2, wherein the base plate portion of the stopper includes an U-shaped bent portion through which a wire spring is inserted so that the depress means is normally projected above the outer surface of the wick control handle.

* * * * *